United States Patent [19]

Gilmore

[11] Patent Number: 5,038,811

[45] Date of Patent: Aug. 13, 1991

[54] SELF-OPENING CUFF FOR CRUTCH

[75] Inventor: Oscar P. Gilmore, San Bernardino, Calif.

[73] Assignee: Yvonne Johnson, Carlsbad, Calif.

[21] Appl. No.: 617,673

[22] Filed: Nov. 26, 1990

[51] Int. Cl.[5] ..... A61H 3/02

[52] U.S. Cl. ..... 135/71; 135/75; 24/487; 403/119

[58] Field of Search ..... 135/68, 69, 71–73, 135/75; 24/487, 458, 484, 489; 403/119, 161

[56] References Cited

U.S. PATENT DOCUMENTS

| | | | |
|---|---|---|---|
| 1,761,497 | 6/1930 | Smith | 24/484 X |
| 2,711,183 | 6/1955 | Lofstrand, Jr. | 135/69 |
| 3,213,869 | 10/1965 | Frank . | |
| 3,545,462 | 12/1970 | O'Mahoney . | |
| 3,635,233 | 1/1972 | Robertson . | |
| 3,710,807 | 1/1973 | Ferry . | |
| 4,151,853 | 5/1979 | Inbar . | |
| 4,869,280 | 9/1989 | Ewing . | |

FOREIGN PATENT DOCUMENTS

| | | | |
|---|---|---|---|
| 168272 | 5/1951 | Austria | 135/71 |
| 663247 | 12/1951 | United Kingdom | 135/71 |

*Primary Examiner*—David A. Scherbel
*Assistant Examiner*—Lan Mai
*Attorney, Agent, or Firm*—Herbert E. Kidder

[57] ABSTRACT

A self-opening cuff comprising a fixed member, to which a cylindrically curved cuff is pivoted for swinging movement in a vertical plane. The fixed member is rigidly attached to the crutch tubing, and has two laterally projecting, angularly spaced side arms with an included angle of approximately 90° between them. The two side arms have a cylindrically curved inner surface with the same radius of curvature as the cuff, and this curved surface is interrupted at its midpoint by a vertical slot. Disposed within the slot and swingably connected to the fixed member by a pivot bolt is a lug which is provided on the outside of the cuff. The top portion of the cylindrically curved surface is smoothly rounded with a curvature having its center at the pivot bolt axis, forming a ramp that the outer surface of the cuff rides on as it swings upwardly. The cuff is a split cylinder having a larger fixed section that is rigidly fixed to the lug, and a smaller section that is hinged closely adjacent the lug and swingable toward and away from the fixed section. When the cuff is positioned between the side arms, both the larger section and smaller sections are backed up by the side arms, locking the cuff in the closed position. When the cuff is swung up to its raised position, both sections slide up over the ramp until they are clear of the side arms, at which point the smaller hinged section drops open by gravity, opening the cuff so that the user can insert his forearm sideways into the same.

7 Claims, 3 Drawing Sheets

25°
7
19
36
40
29
20
30
18
22
17
7

19
36
34
37
30
22
21
18
17

SELF-OPENING CUFF FOR CRUTCH

BACKGROUND OF THE INVENTION

The present invention pertains to crutches, and more particularly to a type of crutch that is worn on the arm, and has a cuff embracing the forearm of the user.

While the forearm crutch in present usage has many advantages over the conventional underarm crutch, it also has a few disadvantages of its own, which give trouble to the wearer. One of the more objectionable features of the prior art crutch is the difficulty of getting one's forearm into and out of the cuff while wearing bulky apparel such as coats, sweaters and the like. This is because the cuff is usually made of spring steel or other resilient material, curved to form a C-shaped collar which fits snugly around the forearm, and to get the forearm down into the cuff, it is necessary to spread the two sides of the cuff apart to make room. With bulky clothes, this can be a real problem. It is also difficult to remove the forearm from the cuff, as the spring tension tends to grip the sleeve. Even without bulky clothing, it is difficult for many users to get into and out of the cuff.

Another disadvantage or prior crutches is that they sometimes fail to release the forearm from the cuff if the user should accidentally fall, causing serious injury to the user.

A serious objection of prior cuffs is that frequent insertion and removal of the hand lengthwise through the fixed spring steel cuff causes abrasion and chafing of the skin over the thumb metacarpal bone, which becomes extremely painful and is subject to infection. This can become enough of a problem to cause the user to refrain from using the crutch as much as possible so as to spare the wound from further injury.

Prior cuffs also have a disconcerning tendency to slip off the forearm when the forearm is raised to the horizontal position while the crutch hangs vertically from the cuff, particularly when the ulna and radius arm bones are rotated so that they are in a vertical plane.

Another problem with prior crutch cuffs is that in order to allow expansion for lengthwise indertion of the hand and forearm, the cuffs are usually loose-fitting and do not grip the forearm with the firmness needed to create confidence in the stability of the crutch.

A further objection to the conventional crutch cuff is that the other hand is usually required to help open the cuff and keep it open while inserting the one hand through the cuff.

These and other objectionable shortcomings of the conventional cuff have greatly reduced the convenience and favorable perception of the forearm crutch.

SUMMARY OF THE INVENTION

The primary object of the present invention is to provide a new and improved form of forearm cuff that is extremely easy to get into or to take off, even when dressed in heavy clothing.

Another object is to provide a forearm cuff that will allow immediate release of the arm if the wearer should accidentally fall, thereby preventing serious injury that might result if the arm could not be released.

A further object of the invention is to provide a cuff that is automatically locked shut when the forearm is essentially parallel to the upper part of the crutch, and which automatically opens when the forearm is raised so that it is essentially perpendicular to the crutch. A particularly important advantage of this feature of the invention is that it retains its firm grip on the forearm in a positive manner, and will not slip off the arm under sideways pressure when the arm is parallel to the crutch.

Another object is to provide a cuff that retains its firm grip on the forearm when the arm is raised to the horizontal while the crutch hangs vertically, as when shaking hands or opening a door, and which retains that firm grip regardless or whether the ulna and radius bones are in the horizontal or vertical plane.

An important advantageous feature of the invention is that the pivoted cuff can be produced in various sizes to fit forearms of widely varying size, as well as for the left hand or right hand, with the different cuffs all fitting interchangeably with the locking member to which they are pivotally attached. The cuff assembly is adaptable to virtually all standard forearm crutches.

Other important objects are to provide a cuff that does not abrade the skin over the thumb metacarpal bone when the forearm is inserted into the cuff, as well as a cuff that the forearm can be inserted into or removed from using only one hand.

Other objects and advantages of the invention will become apparent to those skilled in the art from the following detailed description of the preferred embodiment, with reference to the accompanying drawings.

BRIEF DESCRIPTION OF THE DRAWINGS

FIG. 3 is a sectional view taken at 3—3 in FIG. 2;

FIG. 4 is a side view of the cuff assembly, shown with the cuff swung up to approximately the half-open position;

FIG. 5 is an end view, as seen at 5—5 in FIG. 4;

FIG. 6 is a view similar to FIG. 4, showing the cuff in the fully-open position;

FIG. 7 is a view of the cuff assembly, as seen at 7—7 in FIG. 6, showing the fully-opened cuff; and FIG. 8 is a view of a cuff member standing alone, showing a small size cuff for a small forearm, with the slight modification that makes it possible for cuffs of various sizes to fit the same locking member.

DESCRIPTION OF THE PREFERRED EMBODIMENT

Figure 1:
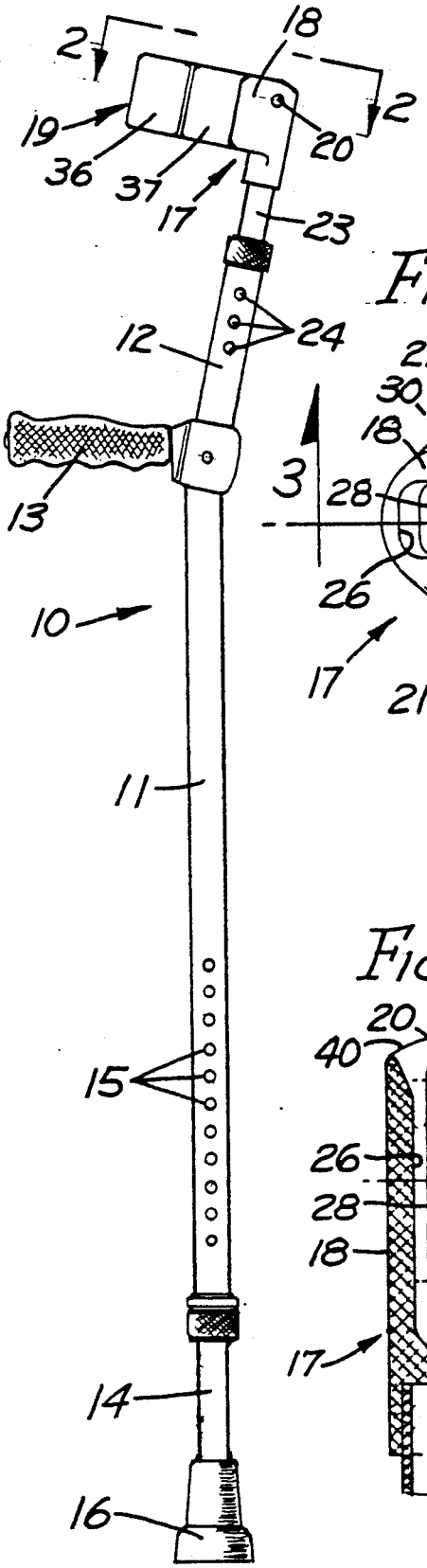
FIG. 1 is a side elevation of a forearm crutch having a self-opening cuff embodying the principles of the invention.

In the drawings a forearm crutch is designated in its entirety by the reference numeral 10, and is seen to comprise a length of aluminum tubing having a straight lower portion 11 and a shorter, slightly angled upper portion 12. Projecting laterally from the lower portion 11 just below the bend is a handle 13, and at its bottom end the tubing portion 11 has a telescoping extension tube 14 that permits length adjustment of the crutch. When the correct length has been obtained, the tubing portions 11 and 14 are locked together by passing a bolt or pin through one of the vertically spaced holes 15 and an aligned hole in the tube 14. A crutch tip 16 is provided on the bottom end of tube 14.

Figure 2:
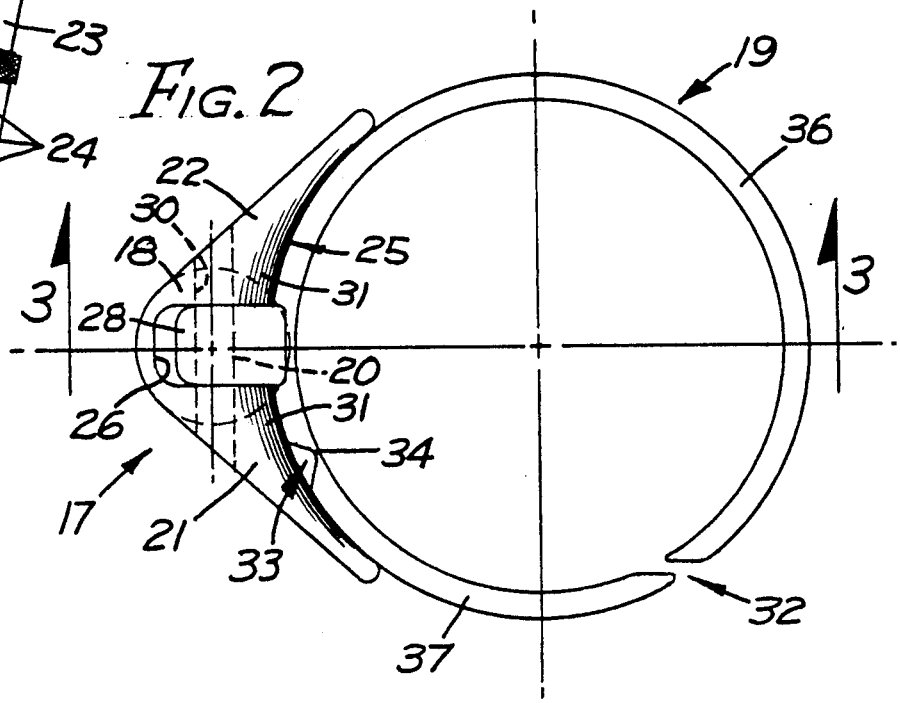
FIG. 2 is an enlarged end view of the cuff assembly, as seen at 2—2 in FIG. 1.

The present invention is the cuff assembly 17 that is carried at the top end of the shorter tubig section 12. Assembly 17 consists of a fixed member 18 and a cylindrically curved cuff 19 that is pivotally connected to member 18 by a pivot bolt 20. Member 18 is preferably an aluminum casting, or molding, having two laterally projecting, angularly spaced side arms 21 and 22, with an included angle or approximately 90° between them, as best shown in FIG. 2. Member 18 has a downwardly projecting tubular shank 23 that is inserted into the open top of tubular section 12 and secured by a screw or pin inserted through one of three length-adjustment holes 24.

Figure 3:
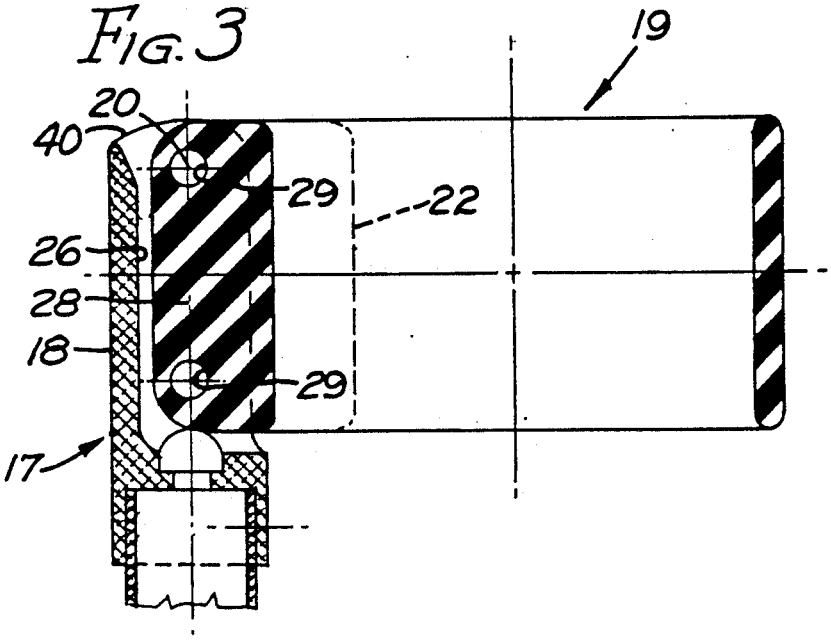
FIGS. 3–8 are drawn to the same scale as FIG. 2.

The two side arms 21, 22 have a cylindrically curved surface 25 (FIG. 2) on their inner sides, of which the radius of curvature is the same as the outside of cylindrical cuff 19. Curved surface 24 is interrupted at its midpoint by a vertical slot 26 (FIGS. 2 and 3), and disposed within this slot is a rectangular lug 28 projecting from one side of the cuff 19. Lug 28 has two bolt holes 29 provided therein, only one of which is used at a time to receive the pivot bolt 20, the other serving as alternate bolt hole when the cuff is inverted for use on the other hand. Thus, the same cuff can be used for either right-hand or left-hand use. When lug 28 is inserted in slot 26, the upper bolt hole 29 aligns with a bolt hole 30 in member 18, and pivot bolt 20 can then be inserted through the aligned bolt holes. The top edge of the cylindrically curved surfaces 25 on both sides of slot 26 are smoothly rounded off, with a curvature having its center at the center of bolt hole 30, forming a ramp 31 that the outer surface of the cuff rides on as it swings upwardly about pivot bolt 20.

Cuff 19, as mentioned earlier, is cylindrically curved and is preferably molded of a fairly rigid yet flexible plastic, such as nylon or delrin. The cuff is in the form of a wide strap, typically about 2 inches wide and 0.130 to 0.180 inches thick. The cylinder is split at 32, and is also grooved at 33, approximately 15° from lug 28, forming a narrow thin hinge section 34. The split 32 and hinge 34 divide the cylindrical cuff strap into a larger section 36 that is fixed with respect to lug 28, and a smaller movable section 37 that is pivoted on section 36 for swinging movement toward and away from the free end of section 36. Section 36 of cuff 19 extends for about 260° of circumferential distance from the hinge 34 to opening 32, leaving section 37 to close the remaining 100° of circumference. These proportions are fairly critical, as it is essential that the larger fixed section 36 overhangs the forearm of the user so that the crutch remains hanging from the forearm, even though the smaller section 37 is wide open, as in FIG. 7, while at the same time the opening provided by section 37 is sufficiently wide to allow the forearm to be removed sideways from the cuff. This arrangement prevents the cuff from falling off the forearm when performing any action that requires the forearm to be horizontal, as when shaking hands or opening a door.

Figure 4:
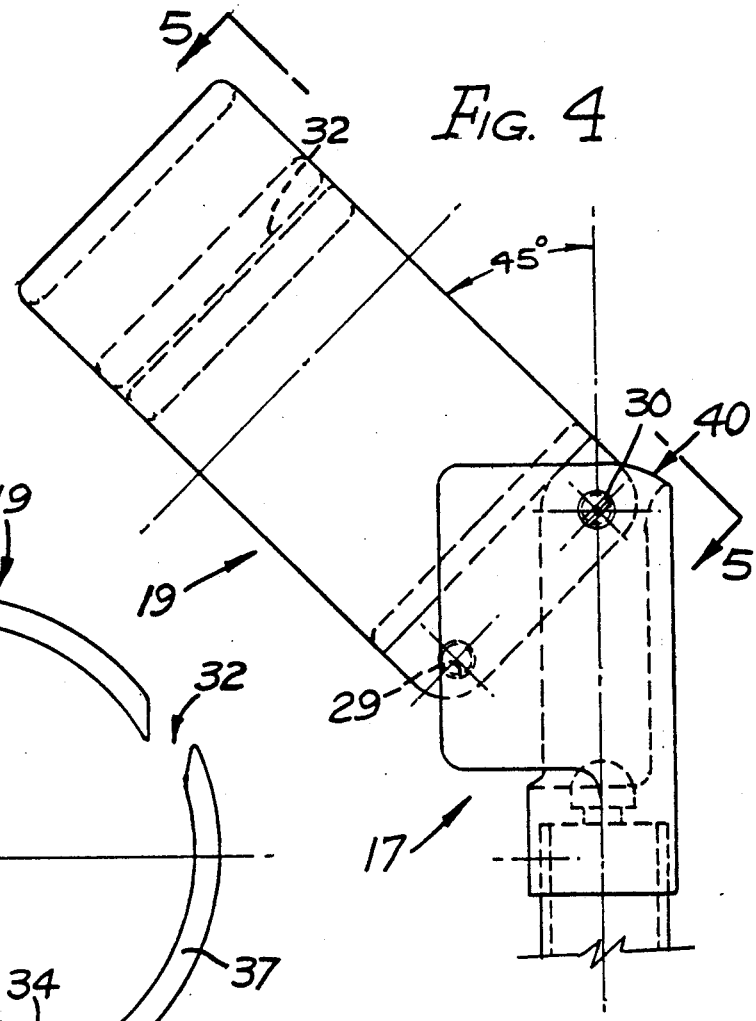
Figure 5:
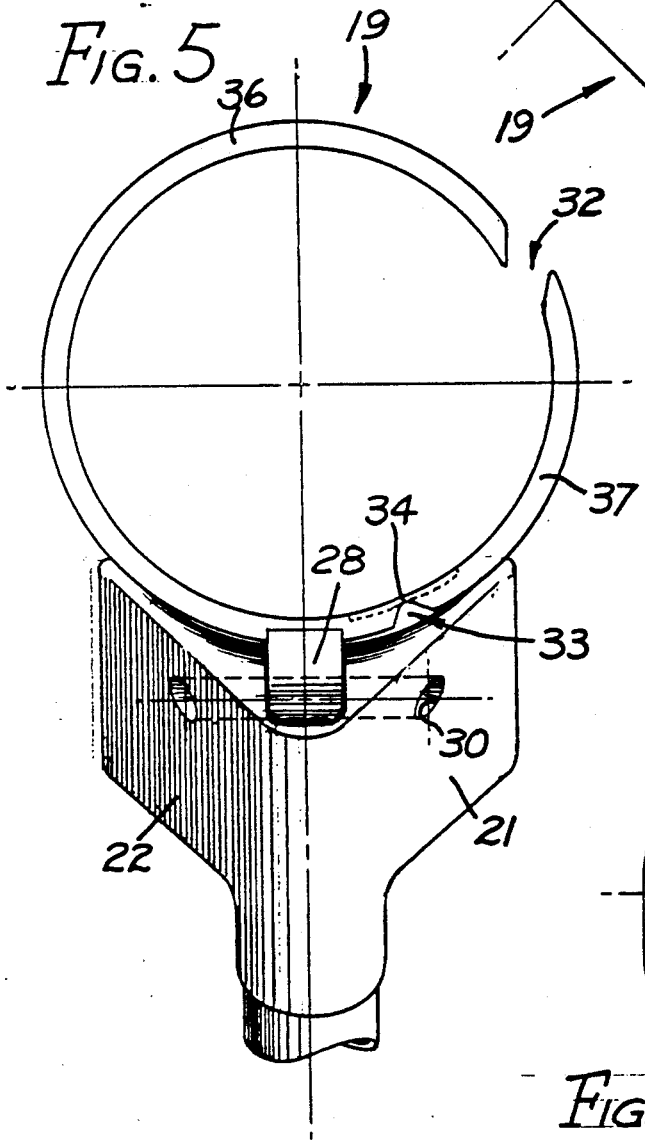
Figure 6:
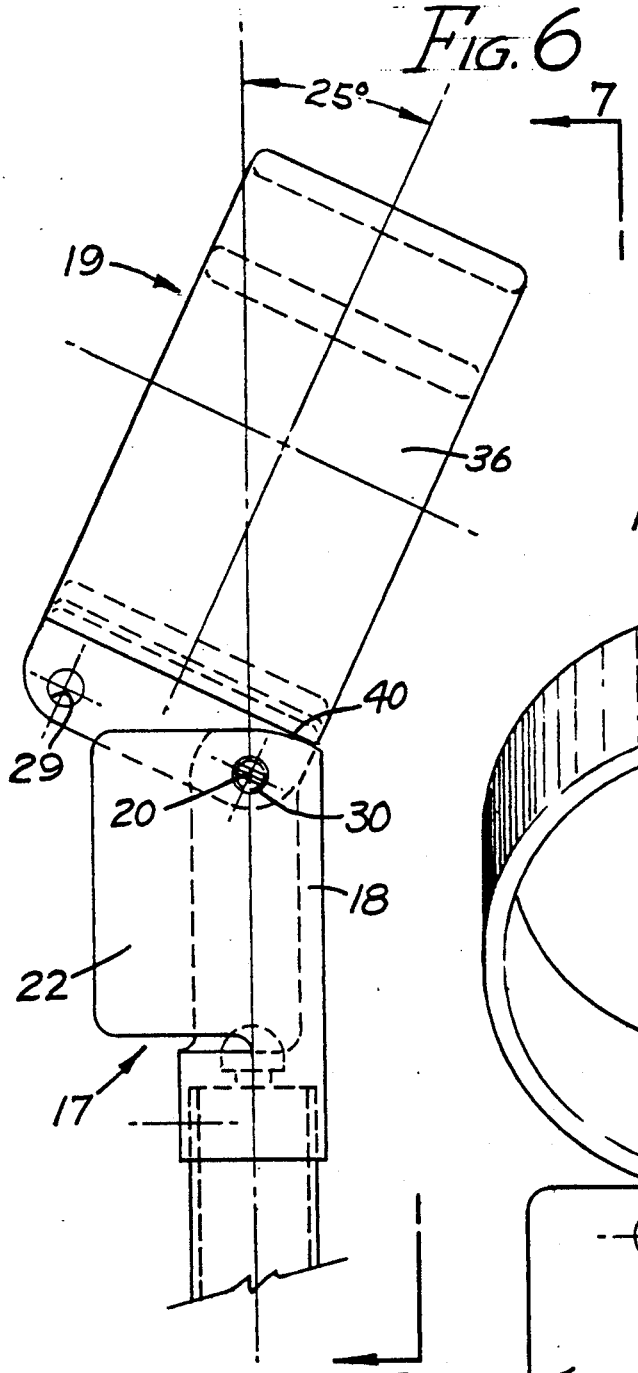
Figure 7:
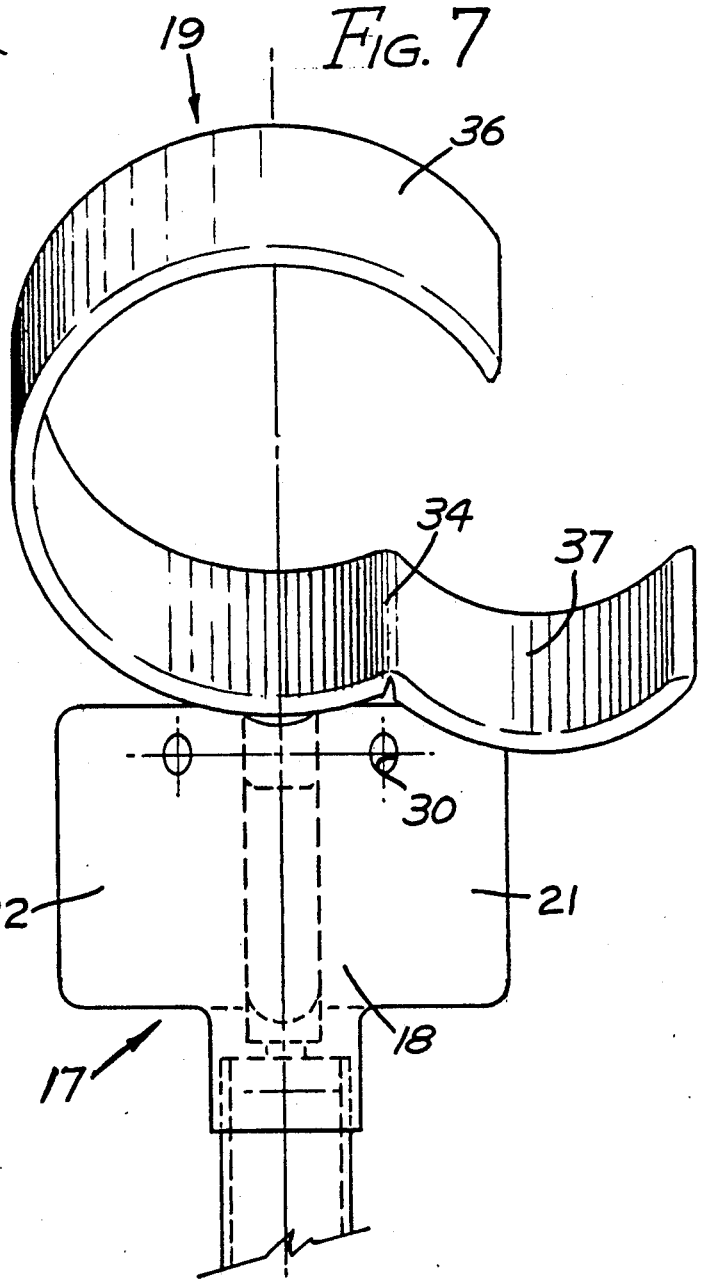

When the cuff 19 is positioned at the lower end of its travel, between the side arms 21, 22, as shown in FIGS. 1 and 2, both the larger section 36 and smaller section 37 are solidly backed up by the side arms 21 and 22 and the cuff is locked in the closed position. As the cuff is swung upwardly about the pivot bolt 20, both sections 16 and 17 slide up over the curved ramp 31, gradually moving the sections out from between the side arms 21, 22, and allowing the smaller hinged section 37 to fall away from section 36 by gravity. FIGS. 4 and 5 show the cuff in its half-open position, with section 37 only slightly moved away from fixed section 36. In FIGS. 6 and 7, the cuff 19 has been swung over to 25° past vertical, with both sections 36 and 37 now completely clear of the side arms 20, 21, and smaller section 37 wide open to allow the forearm to enter or leave the cuff sideways on the side away from the body. In order to permit pivotal movement of the cuff past the vertical, the top surface of member 18 is rounded off at 40 to provide clearance. To place the forearm in the cuff, the user moves the forearm sideways through the opening, and then swings the forearm downwardly to the position shown in FIGS. 1 and 2 to lock the cuff closed. In the operable position, the hand grasps the handle 13, and the crutch now forms a rigid extension of the forearm all the way down to the ground.

One advantage of the invention is that the same cuff 19 can be used by either left-handed or right-handed users, by simply inverting the cuff and passing the pivot bolt 20 through the appropriate hole 29. In most cases, it is desirable to have the opening cuff section 37 on the side away from the body of the user.

Figure 8:
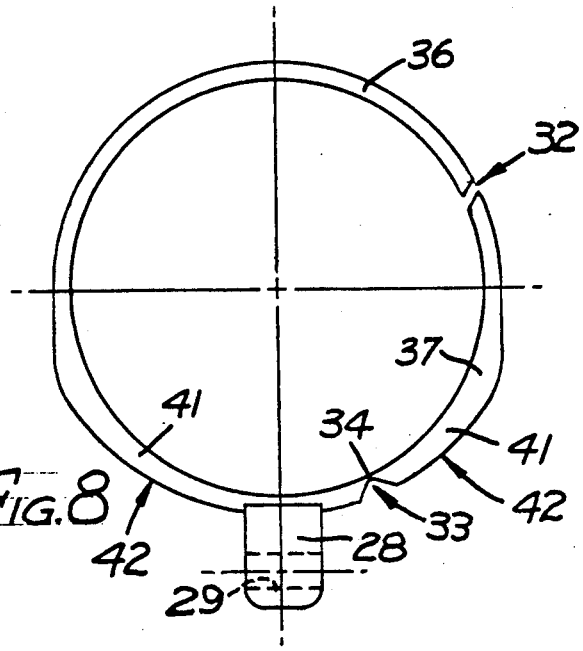

Another advantage is that different size cuffs can be provided for the same fixed section 12. FIG. 8 shows a smaller-size cuff than the one illustrated in FIG. 2, and it will be noted that while the inside diameter of the cylindrical cuff has been reduced to fit a smaller forearm, the portions of the cuff for a short distance to either side of the lug 28 have been thickened at 41, with the outside diameter of the thickened portion formed with the same radius of curvature 42 as the curved surfaces 25 on side arms 21, 22. Thus, the outside cylindrical surface 42 of the cuff matches the curvature of the side arms, while the inside cylindrical surface fits the forearm of the user.

The correctly-sized cuff 19 grips the forearm with a firm yet comfortable grip, giving the user a feeling of complete confidence in the security and stability of the crutch, which is extremely important. Should the user release the handle 13 and raise the forearm to the horizontal position so as to open a door or to shake hands, the cuff continues to retain its grip on the forearm by hanging from cuff member 36 that overlies the forearm. Even if the smaller cuff member 37 opens partially or fully, the opening is to the side, and the cuff will not release the forearm unless the latter is removed sideways.

While I have shown and described in considerable detail what I believe to be the preferred form of my invention, it will be understood by those skilled in the art that the invention is not limited by such details, but may take other forms within the scope of the following claims.

What I claim is:

1. A self-opening forearm cuff for a crutch comprising, in combination:

a fixed member attached to one end of the crutch;

a generally cylindrical cuff attached to said fixed member for movement between a closed position and an open position;

said cylindrical cuff being split to form a first portion moveable solely movement between said closed and open positions, and a second portion that is hinged to said first portion for swinging movement toward and away from said first portion;

said fixed member having areas that contact the outer surface of said first and second cuff portions to lock said cuff in said closed position; and said cuff portions moving clear of said areas when moved to said open position, so as to allow said hinged second cuff portion to move away from said first cuff portion.

2. A self-opening forearm cuff, as set forth in claim 1, wherein:

said cylindrical cuff is pivotally connected to said fixed member for vertical swinging movement between a lowered closed position and a raised open position; and said fixed member having cylindrically curved areas that bear against the outer surface of said first and second cuff portions when said cuff is in said lowered position.

3. A self-opening forearm cuff as in claim 2, wherein:

said fixed member includes a pair of laterally extending, angularly spaced side arms that extend over a substantial portion of the circumference of said cylindrical cuff; and said side arms have a cylindrical curve on their inner surfaces with a radius of curvature approximately the same as the outer surface of said cylindrical cuff, so that said side arms have a substantial area of contact with the cuff.

4. A self-opening forearm cuff as set forth in claim 1, wherein said first cuff portion extends for a circumferential distance substantially greater than 180° so that its outer end overlies the forearm when the latter is approximately horizontal and the crutch hangs vertically; and said second cuff portion is located at the side of the cuff when the latter is in said open position so that the forearm must be withdrawn sideways through the opening.

5. A self-opening forearm cuff for a crutch, comprising, in combination:

a locking member fixedly attached to the upper end of the crutch, said locking member having a pair of angularly spaced-apart side arms extending laterally from the crutch; and a generally cylindrical cuff shaped and proportioned to fit the forearm of the user, said cuff being split to form a first portion and a second portion, and said first portion being pivotally connected to said locking member for swinging movement in a plane perpendicular to the plane of said side arms between a closed position between the side arms and an open position clear of the side arms;

said second portion being hinged to said first portion adjacent the pivot and swingable toward and away from the first portion so as to provide an opening through which the forearm can be inserted when the first member is in said open position;

both said first and second cuff portions being backed up by said side arms when in said closed position so that the cuff is locked closed; and said second portion swinging outwardly away from said first portion when they are in said open position so as to provide an opening in the cuff.

6. A self-opening forearm cuff as set forth in claim 5, wherein said side arms have rounded ramp surfaces on their inner top edges which have radii of curvature centered at the pivot center, so that said cuff portions ride on the ramp surfaces as the cuff swings from closed to open position, thereby keeping the cuff closed until it is in substantially the fully-open position.

7. A self-opening forearm cuff as set forth in claim 5, wherein said first cuff portion extends for approximately 260° of circumferential distance from the hinge of said second portion so that the outer end of the first cuff portion overlies the forearm when the latter is approximately horizontal and the crutch hangs vertically from the pivot;

said second cuff portion being located at the side of the cuff when the latter is in said open position so that the forearm must be withdrawn sideways through the opening.

* * * * *